US010758023B1

(12) United States Patent
Cha et al.

(10) Patent No.: US 10,758,023 B1
(45) Date of Patent: Sep. 1, 2020

(54) COSMETIC CONTAINER

(71) Applicant: YONWOO CO., LTD., Incheon (KR)

(72) Inventors: Gi Yeong Cha, Incheon (KR); Yu Seob Kim, Incheon (KR); Min-Goo Kim, Incheon (KR)

(73) Assignee: YONWOO CO., LTD., Incheon (KR)

( * ) Notice: Subject to any disclaimer, the term of this patent is extended or adjusted under 35 U.S.C. 154(b) by 0 days.

(21) Appl. No.: 16/800,494

(22) Filed: Feb. 25, 2020

(30) Foreign Application Priority Data

May 1, 2019 (KR) ..... 10-2019-0051165

(51) Int. Cl.
*A45D 33/00* (2006.01)
*B65D 25/20* (2006.01)
*A45D 34/00* (2006.01)

(52) U.S. Cl.
CPC ..... *A45D 33/003* (2013.01); *A45D 34/00* (2013.01); *B65D 25/20* (2013.01); *A45D 2200/052* (2013.01)

(58) Field of Classification Search
CPC ..... A45D 33/00; A45D 33/003; A45D 34/00; B65D 25/20; B65D 25/205; B65D 77/04; B65D 77/00; B65D 77/003; B65D 77/02; B65D 77/0406
USPC ..... 220/23.91
See application file for complete search history.

(56) References Cited

U.S. PATENT DOCUMENTS 3,311,248 A * 3/1967 Marchant ..... A45D 40/0068 215/13.1
6,923,347 B2 * 8/2005 Winckels ..... A45D 40/0068 206/229
10,160,578 B2 * 12/2018 Harvey ..... B65D 25/34
10,441,052 B1 * 10/2019 Tapocik ..... A45D 34/045
2016/0167845 A1 * 6/2016 Harvey ..... B65D 65/08 220/23.91

FOREIGN PATENT DOCUMENTS

JP 2012-250733 A 12/2012
JP 2012250733 A * 12/2012
JP 2018-070182 A 5/2018
KR 10-2017-0023431 A 3/2017

* cited by examiner

*Primary Examiner* — Steven A. Reynolds
*Assistant Examiner* — Javier A Pagan
(74) *Attorney, Agent, or Firm* — Novick, Kim & Lee, PLLC; Sang Ho Lee

(57) ABSTRACT

The present invention relates to a cosmetic container including: a container body made of a paper material; an inner container inserted into the container body to store a cosmetic content; and an overcap coupled to top of the inner container to open and close the inner container, wherein as the inner container is inserted into the container body, an outer peripheral surface of the inner container comes into contact with an inner peripheral surface of the container body, thereby allowing the inner container to be coupled to the container body.

4 Claims, 4 Drawing Sheets

COSMETIC CONTAINER

CROSS REFERENCE TO RELATED APPLICATION OF THE INVENTION

The present application claims the priority to Korean Patent Application No. 10-2019-0051165 filed in the Korean Intellectual Property Office on May 1, 2019, the entire contents of which are incorporated herein by reference.

BACKGROUND OF THE INVENTION

Field of the Invention

The present invention relates to a cosmetic container, and more particularly, to a cosmetic container that is capable of being made of an eco-friendly material and intuitively identifying a cosmetic content stored therein.

Background of the Related Art

Generally, cosmetics are accommodated in various containers according to their properties, state, function or purpose, and so as to use a cosmetic material stored in the container, typically, an overcap is first open to apply the cosmetic material to a user's skin through a user's hand or puff or pumping means.

By the way, all parts constituting the conventional cosmetic containers are made of synthetic resin materials which are not eco-friendly, thereby causing consumption of resources, and besides, the conventional cosmetic containers need high-priced complicated devices for performing high temperature molding, thereby having limitations in lowering manufacturing costs.

On the other hand, the cosmetics are classified into basic cosmetics like skin a toner and a lotion, functional cosmetics like essence, and makeup cosmetics like foundation, but if it is desired to use the cosmetics, first, it should be checked whether the cosmetics are the basic cosmetics, the functional cosmetics, or the makeup cosmetics through the characters indicated on their container bodies, thereby causing many inconveniences of use. As kinds of cosmetics have been recently diversified, further, various products by line such as products for men, eco-friendly products, and the like have been launched, and accordingly, there is a need to develop a new cosmetic container capable of intuitively identifying a kind of cosmetic material stored therein.

SUMMARY OF THE INVENTION

Accordingly, the present invention has been made in view of the above-mentioned problems occurring in the prior art, and it is an object of the present invention to provide a cosmetic container that is capable of allowing a container body to be made of a paper material to provide an eco-friendly image and capable of intuitively identifying a cosmetic content stored therein through colors indicated on an identification portion.

To accomplish the above-mentioned object, according to the present invention, there is provided a cosmetic container including: a container body made of a paper material; an inner container inserted into the container body to store a cosmetic content; and an overcap coupled to top of the inner container to open and close the inner container, wherein as the inner container is inserted into the container body, an outer peripheral surface of the inner container comes into contact with an inner peripheral surface of the container body, thereby allowing the inner container to be coupled to the container body.

According to the present invention, desirably, the inner container has an identification portion formed on top thereof in such a manner as to be exposed to the outside, at the time when the inner container is coupled to the container body and the overcap, to indicate a color through which the cosmetic content is identified.

According to the present invention, desirably, the inner container has a plurality of coupling protrusions protruding outward from the outer peripheral surface thereof, so that as the inner container is inserted into the container body, the plurality of coupling protrusions comes into contact with the inner peripheral surface of the container body, thereby allowing the inner container to be coupled to the container body.

According to the present invention, desirably, each coupling protrusion includes: a pressurizing portion extended by a given length toward up and down directions of the inner container and pressurizingly coming into close contact with the inner peripheral surface of the container body; and a guide slant portion extended from a lower side end portion of the pressuring portion in such a manner as to be decreased in a protruding height toward the lower side thereof to allow at least a portion thereof to be slant to form a slant surface.

According to the present invention, desirably, the pressurizing portion becomes narrow in width from the outer peripheral surface of the inner container toward the protruding direction thereof.

According to the present invention, desirably, the inner container has a seating portion protruding outward from the top outer peripheral surface thereof in such a manner as to be seated onto the top end periphery of the container body, at the time when the inner container is inserted into the container body, to cover the top end periphery of the container body.

According to the present invention, desirably, the container body has a support portion bent inward along a lower end periphery thereof.

BRIEF DESCRIPTION OF THE DRAWINGS

The above and other objects, features and advantages of the present invention will be apparent from the following detailed description of the preferred embodiments of the invention in conjunction with the accompanying drawings, in which.

DETAILED DESCRIPTION OF THE PREFERRED EMBODIMENTS

Figure 1:
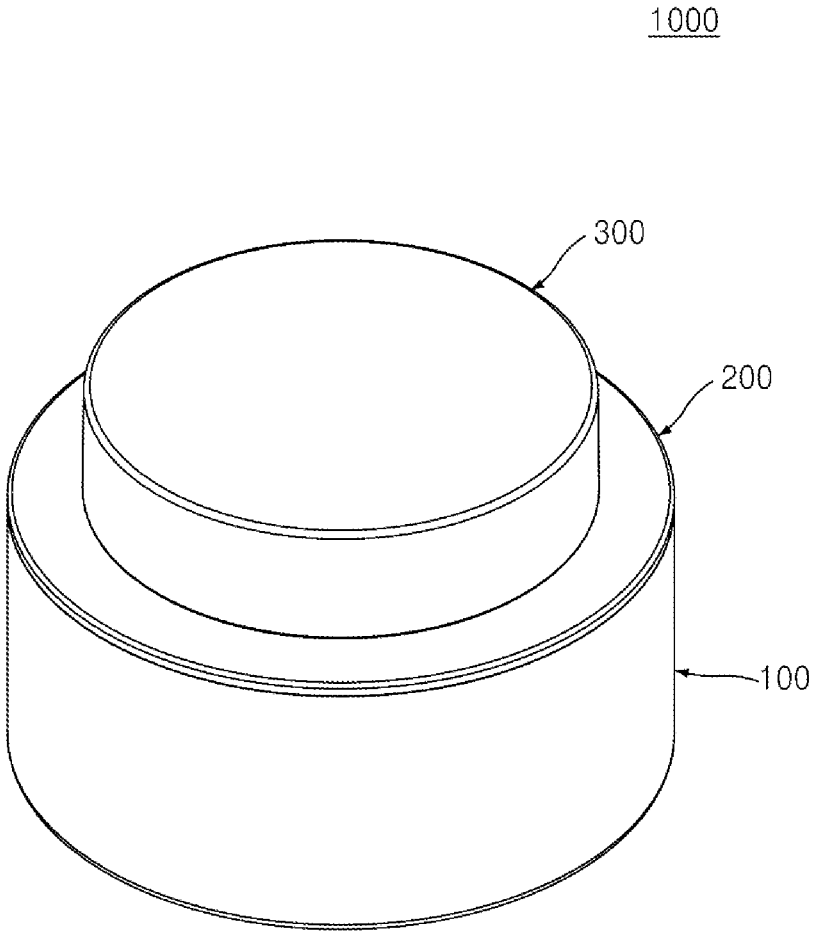
FIG. 1 is a perspective view showing a cosmetic container according to an embodiment of the present invention.

Hereinafter, the present invention is disclosed with reference to the attached drawings wherein the corresponding parts in the embodiments of the present invention are indicated by corresponding reference numerals and the repeated explanation on the corresponding parts will be avoided. If it is determined that the detailed explanation on the well known technology related to the present invention makes the scope of the present invention not clear, the explanation will be avoided for the brevity of the description. Also, an embodiment of the present invention as will be discussed later will be in detail described so that it may be carried out easily by those having ordinary skill in the art, and therefore, this does not limit the idea and technical scope of the invention. In the description, every direction as will be described later may be determined with respect to the drawings, and therefore, they should be not necessarily defined on the basis of the whole scope of the present invention.

When it is said that one element is described as being "connected" or "coupled" to the other element, one element may be directly connected or coupled to the other element, but it should be understood that another element may be present between the two elements. In the description, when it is said that one portion is described as "includes" any component, one element further may include other components unless no specific description is suggested. Terms, such as the first, the second, A, B, (a), and (b) may be used to describe various elements, but the elements should not be restricted by the terms. The terms are used to only distinguish one element from the other element.

Figure 2:
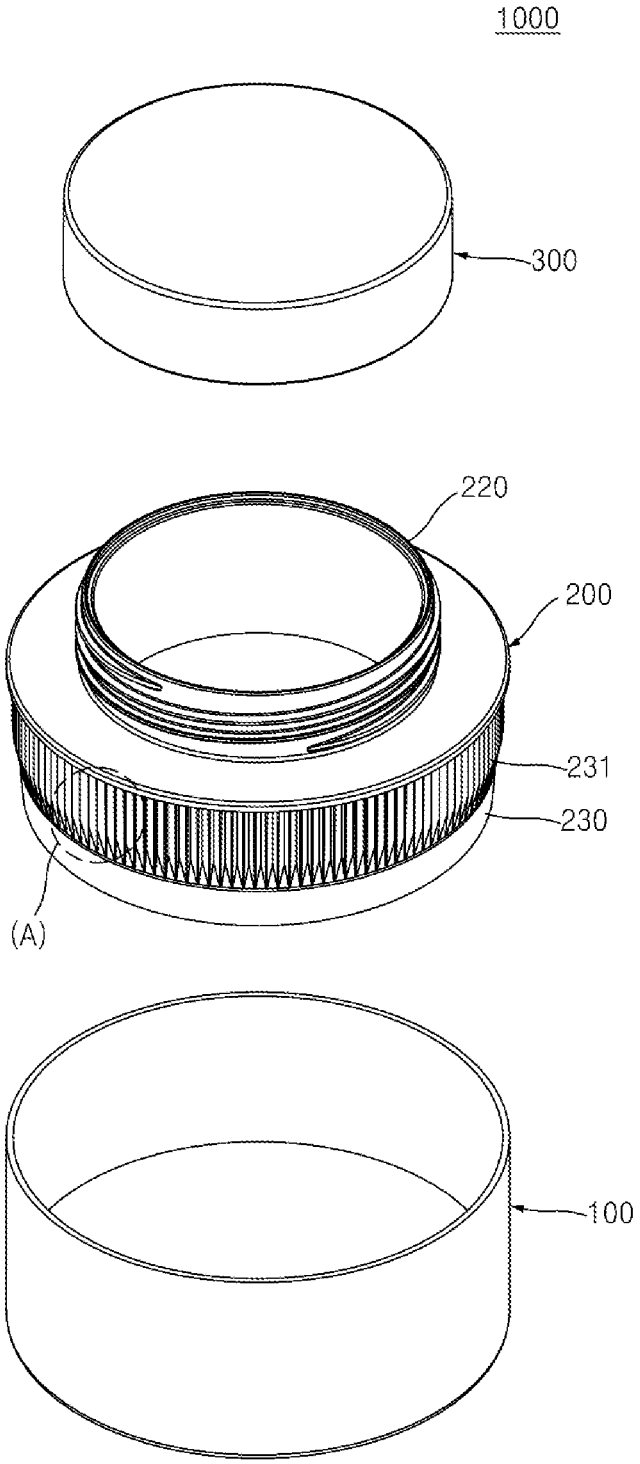
FIG. 2 is an exploded perspective view showing the cosmetic container according to the present invention.
Figure 3:
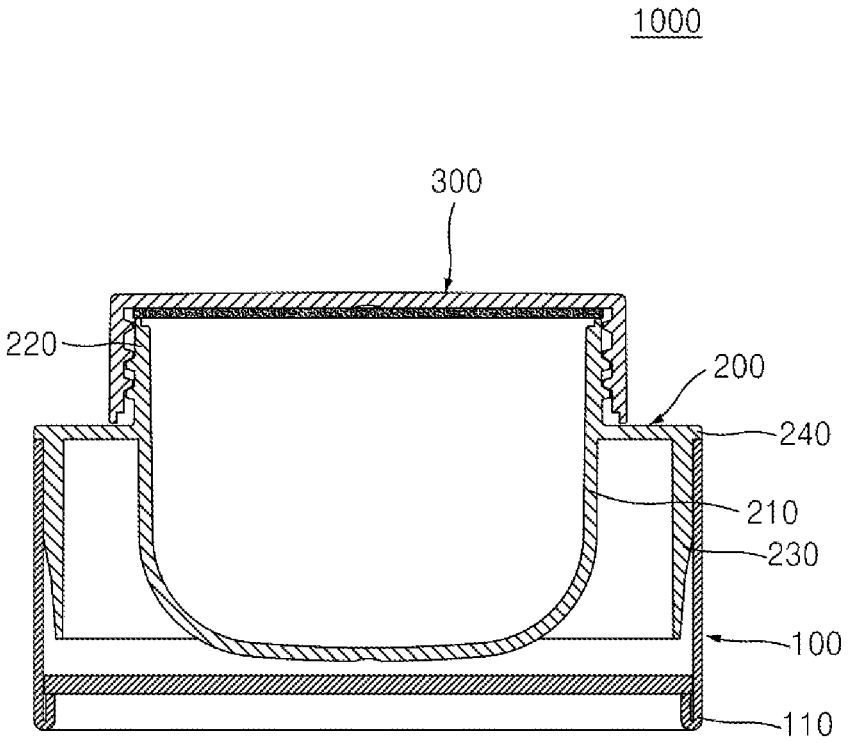
FIG. 3 is a sectional view showing the cosmetic container according to the present invention.
Figure 4:
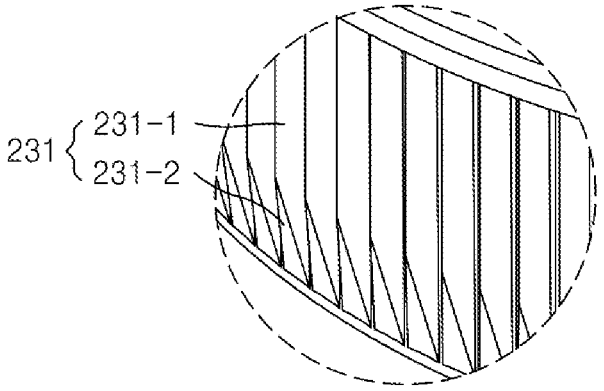
FIG. 4 is an enlarged view showing a portion 'A' of FIG. 2.

FIG. 1 is a perspective view showing a cosmetic container according to an embodiment of the present invention, FIG. 2 is an exploded perspective view showing the cosmetic container according to the present invention, FIG. 3 is a sectional view showing the cosmetic container according to the present invention, and FIG. 4 is an enlarged view showing a portion 'A' of FIG. 2.

As shown in FIGS. 1 to 4, the cosmetic container 1000 according to the present invention largely includes a container body 100, an inner container 200, and an overcap 300.

The container body 100 is open on top thereof in such a manner as to accommodate the inner container 200 therein. For example, the container body 100 has a shape of a cylinder having an accommodation space formed therein.

According to the present invention, the container body 100 is made of a paper material. As the container body 100 is made of a paper material, like this, the cosmetic container 1000 according to the present invention provides an eco-friendly image and is manufactured more economically. Further, characters, drawings, and symbols are indicated on an outer peripheral surface of the container body 100 made of the paper material, and also, post-processes for providing various colors are easily performed, thereby reducing a defect rate. Furthermore, the container body 100 can be recycled after used, thereby advantageously avoiding environmental pollution.

According to the present invention, the container body 100 has a support portion 110 bent inward along a lower end periphery thereof. Accordingly, the support portion 110 has a double structure so that the container body 100 has high durability. Further, if the container body 100 is made of the paper material, a side wall periphery and an underside of the container body 100 have to be separately made and then bonded to each other, but through the inwardly bent lower end periphery of the container body 100, the side wall periphery of the container body 100 can be more easily bonded to the underside thereof. Also, a bonded portion between the side wall periphery and the underside of the container body 100 is not exposed to the outside, thereby protecting the container body 100 from being damaged and broken.

The inner container 200 is accommodated in the container body 100 and has an accommodation portion 210 formed therein to store a cosmetic content. In this case, the cosmetic content is a cosmetic fluid (that is, a cosmetic material) or powder. For example, the cosmetic content includes a cosmetic material like liquid or gel type for skin care or a cosmetic material for make-up, but it may include all fluid or powder type cosmetic materials, without being limited thereto.

The inner container 200 has an open portion 220 formed on top thereof to discharge the cosmetic content stored in the accommodation portion 210 to the outside. Further, the inner container 200 has a screw thread formed on an outer peripheral surface thereof so that it can be coupled to the overcap 300.

As the inner container 200 is inserted into the container body 100, the outer peripheral surface of the inner container 200 comes into contact with the inner peripheral surface of the container body 100, so that the inner container 200 can be coupled to the container body 100. For example, the inner container 200 has a side wall peripheral portion 230 extended downward from the top end periphery thereof by a given length, and the side wall peripheral portion 230 has a plurality of coupling protrusions 231 protruding outward from the outer peripheral surface thereof. If the inner container 200 is inserted into the container body 100, the coupling protrusions 231 formed on the side wall peripheral portion 230 pressurizingly come into contact with the inner peripheral surface of the container body 100, so that the inner container 200 can be press-fitted onto the container body 100.

According to the present invention, the coupling protrusions 231 are equally spaced apart from each other along the outer peripheral surface of the side wall peripheral portion 230, so that they can uniformly pressurize the inner peripheral surface of the container body 100. In detail, the number of coupling protrusions 231 is 3 to 150, and accordingly, the coupling protrusions 231 are equally spaced apart from each other along the outer peripheral surface of the side wall peripheral portion 230. If the number of coupling protrusions 231 is 3, for example, the coupling protrusions 231 are equally spaced apart from each other along the outer peripheral surface of the side wall peripheral portion 230 at intervals of 120° with respect to the center of the inner container 200.

According to the present invention, further, at least a portion of the coupling protrusions 231 may be made of an elastic or soft material.

Each coupling protrusion 231 includes a pressurizing portion 231-1 and a guide slant portion 231-2.

The pressurizing portion 231-1 is extended by a given length toward up and down directions of the inner container 200 and serves to pressurize the inner peripheral surface of the container body 100 at the time when the inner container 200 is inserted into the container body 100. According to the present invention, the pressurizing portion 231-1 becomes narrow in width from the outer peripheral surface of the side wall peripheral portion 230 toward the protruding direction thereof. For example, one side of the pressurizing portion 231-1 coming into contact with the inner peripheral surface of the container body 100 is taperedly formed, which allows the inner container 200 to be more easily inserted into the container body 100.

The guide slant portion 231-2 is extended from the lower side end portion of the pressuring portion 231-1 in such a manner as to be decreased in a protruding height toward the lower side thereof to allow at least a portion thereof to be slant to form a slant surface. Like this, the guide slant portion 231-2 as the slant surface is formed on the lower side of the pressurizing portion 231-1, so that in a process of making the cosmetic container 1000, the inner container 200 can be more easily coupled to the container body 100.

The inner container 200 has a seating portion 240 formed along the top end periphery thereof in such a manner as to be seated onto the top end periphery of the container body 100 at the time when the inner container 200 is inserted into the container body 100. For example, the seating portion 240 protrudes outward from the top outer peripheral surface of the inner container 200 in such a manner as to have a protruding height greater than the coupling protrusions 231. According to the present invention, further, the seating portion 240 is adapted to completely cover the top end periphery of the container body 100 at the time when the inner container 200 is inserted into the container body 100. During the cosmetic container 1000 is used or kept at a given place, accordingly, the top end periphery of the container body 100 is not exposed to the outside, thereby preventing the breakage of the container body 100.

The overcap 300 is detachably coupled to top of the inner container 200 to open and close the open portion 220 and serves to block introduction of foreign matters or air in the inner container 200 to prevent a quality of the cosmetic content stored in the inner container 200 from being deteriorated. For example, the overcap 300 has a screw thread formed along the inner peripheral surface thereof in such a manner as to correspond to the screw thread formed along the outer peripheral surface of the opening portion 220 of the inner container 200, so that through the screw coupling, the overcap 300 is detachably coupled to the inner container 200.

On the other hand, the coupling methods of the parts as mentioned above are just exemplary, and accordingly, various coupling methods may be adopted according to embodiments of the present invention. Instead of the screw coupling, for example, a protrusion and a groove are press-fitted onto each other, and if the press-fitting is adopted, also, positions or shapes of the protrusion and the groove may be changed.

Figure 5:
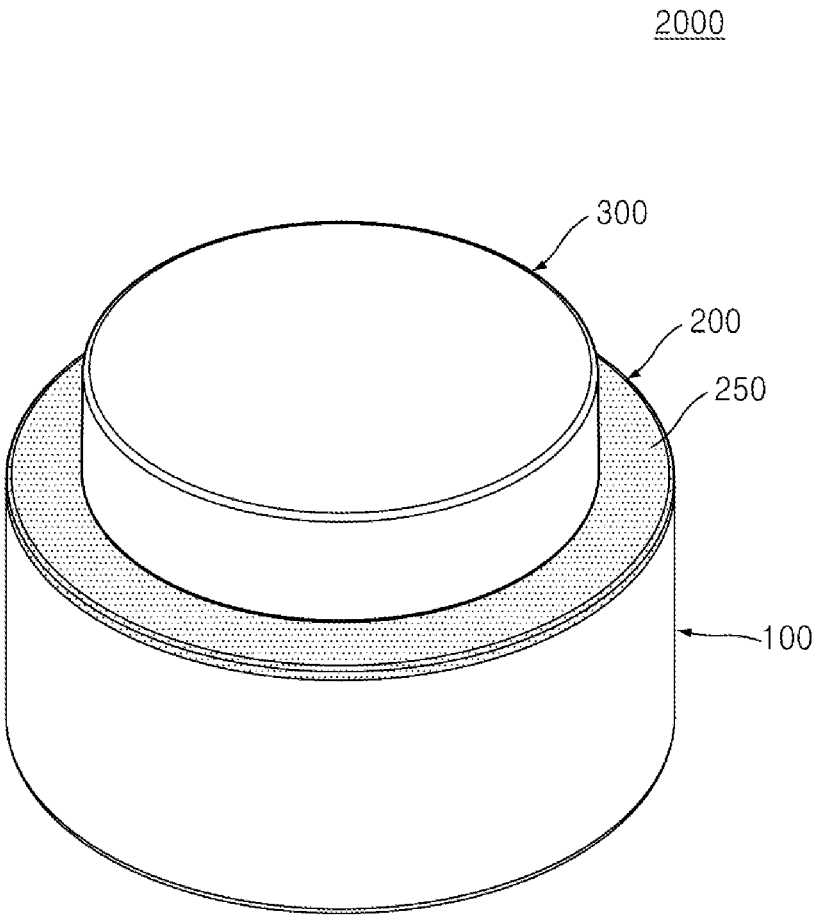
FIG. 5 is a perspective view showing a cosmetic container according to another embodiment of the present invention.

FIG. 5 is a perspective view showing a cosmetic container according to another embodiment of the present invention.

As shown, a cosmetic container 2000 according to another embodiment of the present invention further includes an identification portion 250 formed on top of the inner container 200.

The identification portion 250 is exposed to the outside (that is, a user), in a state where the inner container 200 is coupled to the container body 100 and the overcap 300, thereby allowing the cosmetic content stored in the inner container 200 to be identified by the user. For example, as shown, the identification portion 250 has a shape of a circle surrounding the open portion 220 to which the overcap 300 is coupled and also has different colors according to kinds of cosmetic contents stored in the inner container 200.

Accordingly, the cosmetic content can be intuitively identified by the user through the color of the identification portion 250, and at the time when the cosmetic container is kept at a given place, it can be sortedly stored. In this case, further, many conveniences in use are provided.

According to the present invention, the entire inner container 200 has a color corresponding to the cosmetic content stored therein so that at the time when it is coupled to the container body 100 and the overcap 300, the color of the inner container 200 is exposed to the outside through a portion of the inner container 200 exposed to the outside, thereby forming the identification portion 250. However, the formation of the identification portion 250 as mentioned above is just exemplary, and accordingly, various formation methods may be adopted according to embodiments of the present invention, without being limited thereto. For example, a color corresponding to the cosmetic content is directly printed on a portion of the inner container 200 exposed to the outside, thereby forming the identification portion 250.

As described above, the cosmetic container according to the present invention is configured to allow the container body to be made of the paper material, thereby providing an eco-friendly image and being manufactured more economically, and further, to allow characters, drawings, and symbols to be indicated on the outer peripheral surface of the container body or to allow post-processes for indicating various colors to be easily performed, thereby reducing a defect rate.

Furthermore, the cosmetic container according to the present invention is configured to allow the container body made of the paper material to be recycled after used, thereby avoiding environmental pollution.

In addition, the cosmetic container according to the present invention is configured to allow, as the inner container is inserted into the container body, the coupling protrusions formed on the outer peripheral surface of the inner container to pressurize the inner peripheral surface of the container body, thereby more easily coupling the inner container and the container body and firmly supporting the shape of the container body made of the paper material.

Also, the cosmetic container according to the present invention is configured to allow the top edge periphery of the container body to be not exposed to the outside through the seating portion at the time when the inner container is coupled to the container body, thereby preventing the breakage of the container body.

Moreover, the cosmetic container according to the present invention is configured to allow the cosmetic content to be intuitively identified by the user through the color of the identification portion, so that at the time when the cosmetic container is kept at a given place, it can be sortedly stored and many conveniences in use are provided.

The present invention may be modified in various ways and may have several exemplary embodiments. Terms used in this application are used to only describe specific exemplary embodiments and are not intended to restrict the present invention. Accordingly, it should be understood that the invention covers all the modifications, equivalents, and replacements within the idea and technical scope of the invention. Therefore, the present invention is not to be restricted by the embodiment but only by the appended claims.

What is claimed is:

1. A cosmetic container comprising:

a container body made of a paper material;

an inner container inserted into the container body to store a cosmetic content; and an overcap coupled to a top of the inner container to open and close the inner container, wherein the inner container has a plurality of coupling protrusions protruding outward from an outer peripheral surface thereof, and as the inner container is inserted into the container body, the plurality of coupling protrusions comes into contact with an inner peripheral surface of the container body, thereby allowing the inner container to be coupled to the container body, and wherein each of the plurality of coupling protrusions comprises:

a pressurizing portion extended by a given length toward up and down directions of the inner container and coming into close contact with and pressurizing the inner peripheral surface of the container body; and a guide slant portion extended from a lower side end portion of the pressuring portion and decreasing in a protruding height toward a lower side thereof to allow at least a portion thereof to have a slant surface, wherein the pressurizing portion has one side narrow taperedly in width from the outer peripheral surface of the inner container toward a protruding direction thereof and comes into contact with the inner peripheral surface of the container body.

2. The cosmetic container of claim 1, wherein the inner container has an identification portion disposed on the top thereof and when the inner container is coupled to the container body and the overcap, the identification portion is exposed to an outside to indicate an identifying color of the cosmetic content.

3. The cosmetic container of claim 1, wherein the inner container has a seating portion protruding outward from a top outer peripheral surface thereof and when the inner container is inserted into the container body, the seating portion is seated onto a top end periphery of the container body to cover the top end periphery of the container body.

4. The cosmetic container of claim 1, wherein the container body has a support portion bent inward along a lower end periphery thereof.

* * * * *